US007887303B2

(12) United States Patent
Sadkowski et al.

(10) Patent No.: US 7,887,303 B2
(45) Date of Patent: Feb. 15, 2011

(54) AIR COMPRESSOR SYSTEM

(75) Inventors: William E. Sadkowski, Anderson, SC (US); Richard L. Strack, Anderson, SC (US); Douglas Ritterling, Anderson, SC (US)

(73) Assignee: Techtronic Power Tools Technology Limited, Tortola (VG)

( * ) Notice: Subject to any disclaimer, the term of this patent is extended or adjusted under 35 U.S.C. 154(b) by 7 days.

(21) Appl. No.: 12/060,952

(22) Filed: Apr. 2, 2008

(65) Prior Publication Data

US 2008/0273994 A1 Nov. 6, 2008

Related U.S. Application Data

(60) Provisional application No. 60/909,836, filed on Apr. 3, 2007.

(51) Int. Cl.
*F04B 53/22* (2006.01)

(52) U.S. Cl. ..... 417/234

(58) Field of Classification Search ..... 417/234, 417/360; 29/888.02
See application file for complete search history.

(56) References Cited

U.S. PATENT DOCUMENTS

| | | | | |
|---|---|---|---|---|
| 6,375,437 | B1 | 4/2002 | Nolan | |
| 6,485,269 | B1 | 11/2002 | Matthew et al. | |
| 6,537,039 | B2 * | 3/2003 | Mann | 417/234 |
| 2001/0005481 | A1 | 6/2001 | Mann | |
| 2002/0131872 | A1 | 9/2002 | Lucchi | |
| 2004/0028535 | A1 | 2/2004 | Brashears et al. | |
| 2006/0067836 | A1 | 3/2006 | Smith et al. | |
| 2008/0023100 | A1 * | 1/2008 | Wonders | 141/95 |

OTHER PUBLICATIONS

International Search Report and Written Opinion from International Searching Authority for PCT/US2008/057972 dated Jul. 22, 2008 (11 pages).

* cited by examiner

*Primary Examiner*—Devon C Kramer
*Assistant Examiner*—Bryan Lettman
(74) *Attorney, Agent, or Firm*—Michael Best & Friedrich LLP

(57) ABSTRACT

An air compressor includes a compressor pump, a first air tank and a second air tank. The first air tank is in fluid communication with the output of the compressor pump and the second tank. The air compressor can be operated with the second air tank physically connected to the first air tank, or with the second air tank removed from the first air tank.

24 Claims, 9 Drawing Sheets

10
20
24
25
26C
27
28
30
31
32
34
36
40
50
54
60
61
70
72
74
76
78
80
90
96

AIR COMPRESSOR SYSTEM

CROSS-REFERENCE TO RELATED APPLICATIONS

This application claims priority from U.S. Provisional Application Ser. No. 60/909,836, filed on Apr. 3, 2007, the entirety of which is hereby fully incorporated by reference herein.

BACKGROUND

This invention relates to sources of high pressure air and to air compressors.

Air compressors are used to provide compressed air for operating air operated tools such as nailing tools, socket driving tools, material shaping tools, sanding tools, spray painting tools, inflation chucks, and the like. Often, because of various constraints including size, weight, and available sources of electrical power, the air compressor must be remotely located from the tools for which it provides air. As a result, a hose having a substantial length is required to connect the compressor to the tool. The use of a long stretch of hose causes a pressure differential between the air compressor outlet and the working tool, which has several problematic effects.

Initially, because there is a pressure drop through the hose between the air compressor and the tool, the operating pressure of the air compressor must be increased to achieve the desired air pressure level at the remote tool. This higher pressure will cause the air compressor to have a longer operational cycle than would be required to maintain a lower pressure level within the compressor, and the operation of the compressor requires additional electrical power to operate the compressor. Additionally, because of the resistance to air flow through a long hose, the system is not as responsive to maintain the output air pressure at a useable level when the user demands a large volume of compressed air.

Additionally, because the worker often uses a pneumatic tool at a significant distance from the air compressor, the worker often cannot quickly and conveniently adjust the output of the air compressor at the work site but must discontinue work and move to the air compressor, lowering the efficiency of the worker, especially in construction situations such as framing where it is not always easy or convenient to move about the work site.

PORTER CABLE® currently markets a line of air compressors that addresses the worker efficiency problem stemming from operating a compressor in a remote location from the work site. For example, PORTER CABLE model C3150 air compressor includes a removable console that includes an input connection, a pressure regulator and associated gauge, and multiple hose connections. In use, the worker connects the console to an output connection on the unit's air tank with a hose and carries the console to the work site. Because the console unit includes a regulator, the worker can adjust the air pressure provided to the air driven tool with the pressure regulator provided on the console at the work site, therefore eliminating some of the inefficiencies of working with a remote air compressor discussed above.

Although the PORTER CABLE C3150 compressor provides for more efficient use at a work site, the design has several drawbacks. Initially, because the console only provides a nominal air storage capacity, this model suffers from the same head loss problem leading to low output pressure at the work site that exists with conventional air compressors.

Therefore, there is a need to provide an air compressor system that may be used remotely at a work site that can provide a responsive, high pressure output that is easily controlled by the worker at the work site.

BRIEF SUMMARY

A first representative embodiment of an air compressor is provided. The air compressor includes a compressor pump powered by a source of electrical power and a first air tank connected to an output of the compressor pump. The first air tank further includes a first output port. A second tank is provided with a second output port and is in removable fluid communication with the first output port. The first and second air tanks further have a releasable mechanical connection that allows the tanks to be separated for transport or for use, and allows the tanks to be securely connected to each other, as desired.

A second representative embodiment of an air compressor is provided. The air compressor includes a first unit comprising an air pump and a first air tank and a second unit comprising a second air tank. The first and second units are mechanically connectable and removable from each other and the first and second air tanks are fluidly connectable independent of the mechanical connection between the first and second units.

Accordingly, an air compressor is provided that includes two distinct units, a pump unit, and a tank unit. The units may be mounted together to operate as a traditional air compressor, or the air compressor can be operated with the pump and tank units separated. Each tank unit may include a regulator and at least one output connection to allow the user to control the output air pressure at the work site, while maximizing the capacity and the efficiency of the air compressor.

Another representative embodiment of an air compressor is provided. The air compressor includes a first unit including a compressor pump and a second unit including a first air tank. The first and second units are mechanically and fluidly attachable and detachable and each of the first and second units are capable of being carried simultaneously on opposite sides of a user's body.

A representative embodiment of a method of manufacturing an air compressor is provided. The method includes the steps of providing a first unit with a compressor pump and providing a second unit with a first air tank. The first and second units are mechanically and fluidly attachable and detachable and each of the first and second units are capable of being carried simultaneously on opposite sides of a user's body.

Advantages of the present invention will become more apparent to those skilled in the art from the following description of the preferred embodiments of the invention that have been shown and described by way of illustration. As will be realized, the invention is capable of other and different embodiments, and its details are capable of modification in various respects. Accordingly, the drawings and description are to be regarded as illustrative in nature and not as restrictive.

DETAILED DESCRIPTION

Figure 2:
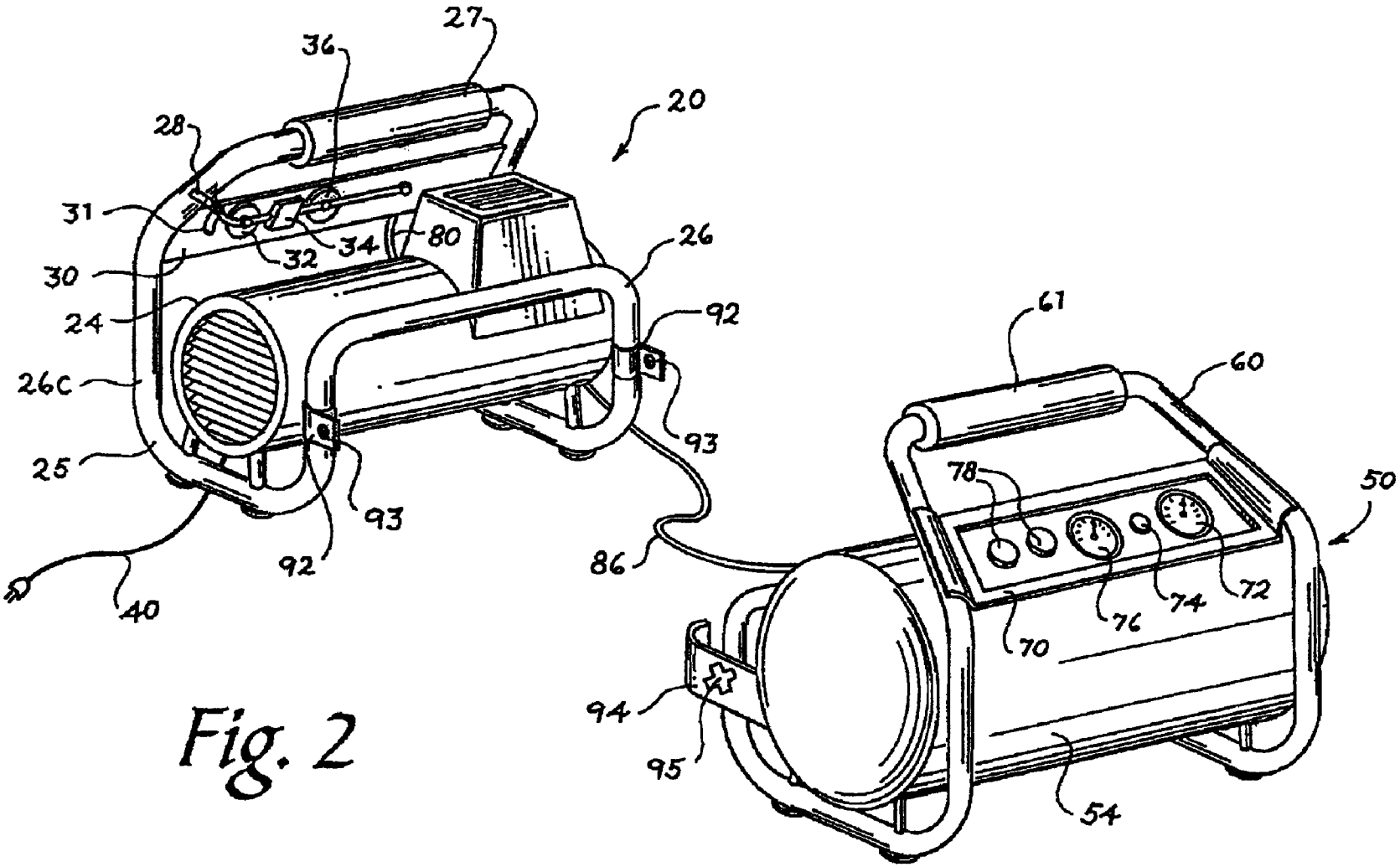
FIG. 2 is a perspective view of the air compressor of FIG. 1 showing the pump unit and the tank unit mechanically but not fluidly separated.
Figure 3:
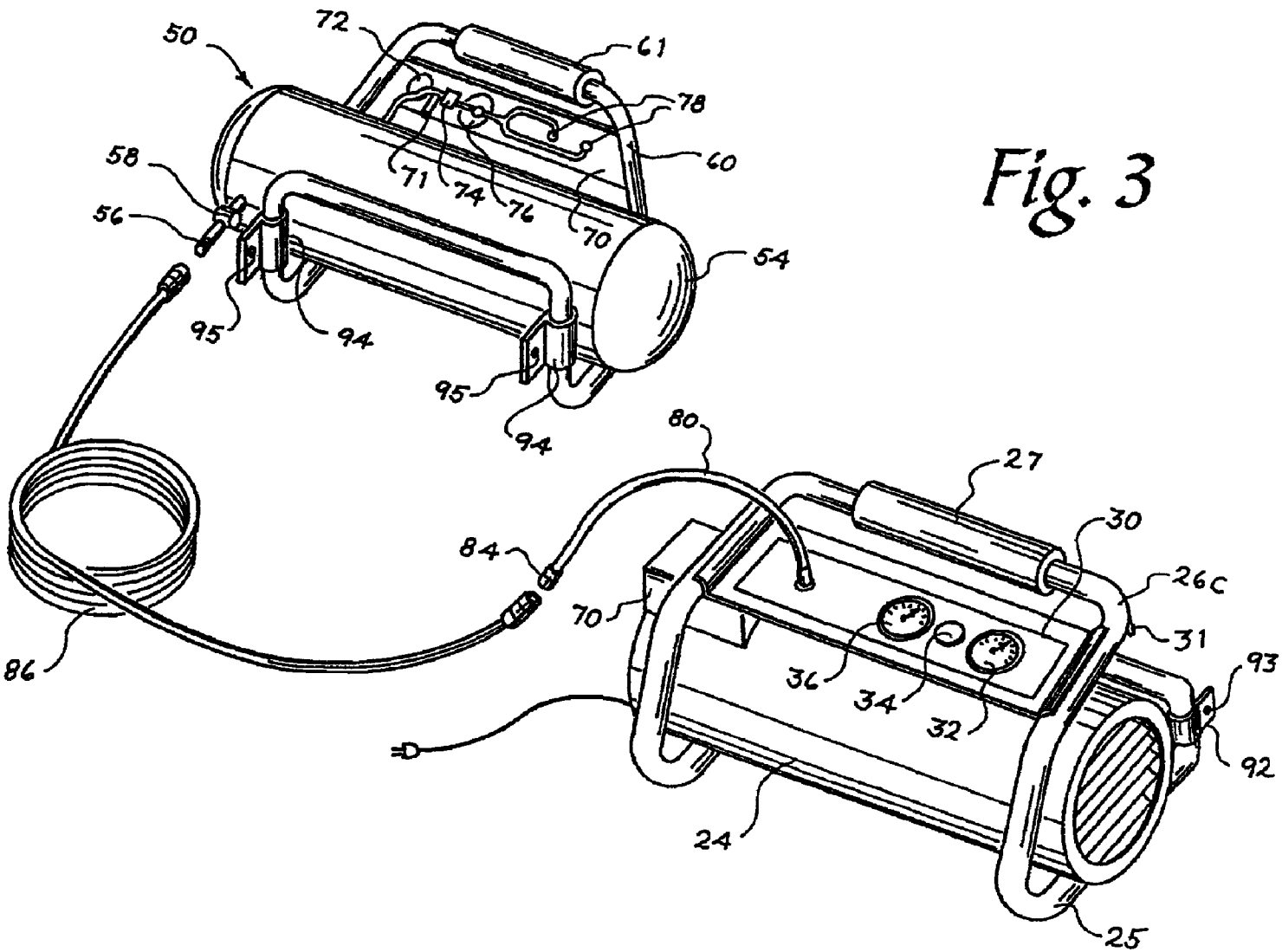
FIG. 3 is an opposite perspective view of the air compressor of FIG. 1 showing the pump unit and the tank unit mechanically and fluidly separated.
Figure 8:
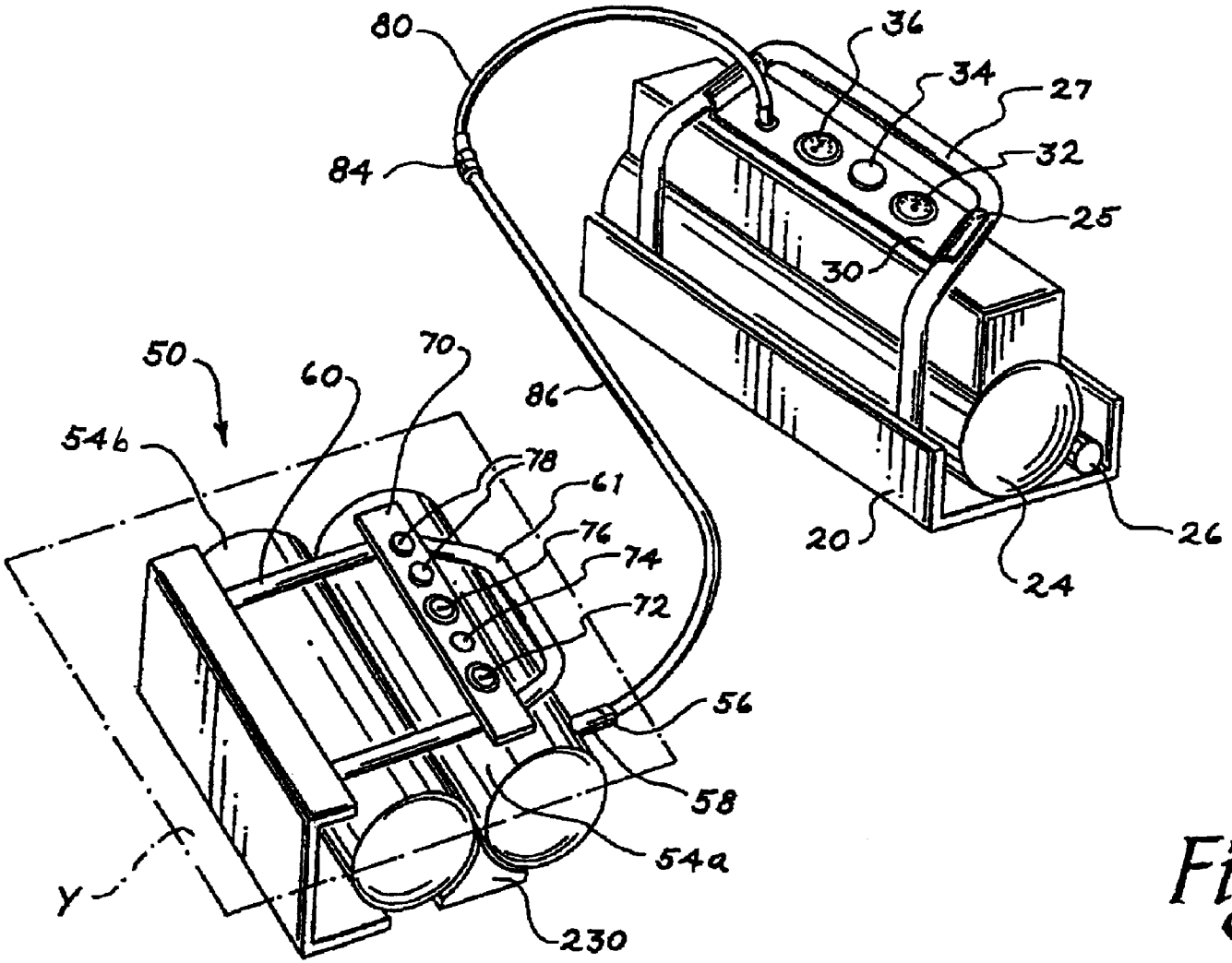
FIG. 8 is a perspective view of the air compressor of FIG. 4 showing the pump and tank units positioned remotely from each other.

Turning now to the figures, an air compressor 10 is provided. The air compressor 10 includes an electrically driven air pump 24, a power cord 40 connectable with a source of electrical current, a first air tank 26 fluidly connected to the pump 24, a second tank 54, a removable flow path between the first tank 26 and the second tank 54, a pressure regulator 74, a tank pressure gauge 72, and an output connection 78. The air compressor 10 includes two units, the pump unit 20 and the tank unit 50. The air compressor 10 may be operated with the pump and tank units 20, 50 attached (FIGS. 1 and 5) or separated (FIGS. 2, 3, and 8). The air compressor 10 may also be operated with only the pump unit 20 to provide a source of air. Further, the tank unit 50 may be used alone to provide a source of compressed air without fluid connection with the tank unit 20.

The pump unit 20 may operate as a stand alone air compressor. The pump unit 20 is powered from a source of electrical power, such as batteries or by AC current delivered to the pump unit 20 by an electrical cord. The pump unit 20 may additionally include a first air tank 26 that is provided downstream of the air pump 24 to store a volume of compressed air. Alternatively, the first tank 26 may be configured as one or more of a "hot dog" style tanks, or the first tank 26 may include an air tank 26*c* defined within the internal volume of the frame 25 or roll-cage that surrounds the majority of the tank unit 20 (FIGS. 1-4). Alternatively, the first tank 26 may be one or more "pancake" style tanks (not shown) or another geometrical shaped tank that is suitable for the pump unit 20. The first tank 26 also may include an output port 28 which is fluidly connected to a pump manifold 30. The pump 20 is surrounded and supported by the roll cage frame 25.

The air pump 24 may be automatically operated to maintain air pressure within the first tank 26 within a predetermined pressure range. The pump unit 20 includes a pressure switch (not shown) provided in fluid communication with the first tank 26 to operate a contact or similar electrical component to selectively allow current to flow to the air pump 24 when the pressure switch senses first tank 26 pressure below the specified pressure within the pressure range and selectively prevents current flow to the pump 24 when the pressure switch senses pressure above a specified pressure within the pressure range. Pressure switches that operate in this manner are well known in the art and further description is not necessary.

In a representative embodiment, the pressure switch shuts (energizing the air pump 24) when it senses pressure at 90 psi or less and opens (securing the air pump 24) when it senses pressure at 150 psi. In other embodiments, different set points may be used. Further, other embodiments allow the user to manually adjust the setpoints of the pressure switch to control the cycling of the air pump 24. In further embodiments, a second or alternate pressure switch may be fluidly connected to the second tank 54 (discussed below) and selectively electrically connectable with the air pump 24 to allow the air pump 24 to cyclically operate to maintain pressure within the second tank 54 within a predetermined or adjustable range.

A pump manifold 30 is fluidly connected to an output 28 of the first tank 26 such that compressed air exiting the first tank 26 flows through the pump manifold 30. The pump manifold 30 may include a first tank pressure gauge 32, a pressure regulator 34 with an associated pressure gauge 36, an output hose 80, and a relief valve 31 upstream of the pressure regulator 34. Alternatively, the relief valve 31 may be provided on the first tank 26. The operation of the pump manifold 30, with the associated pressure regulator 34, and relief valve 31 is well known in the art. The output hose 80, or whip hose, may be mechanically connected to the first manifold 30 on a first end, and include a universal mating output connector 84 on an opposite extended end. In some embodiments, the output connector 84 may be a quick connect coupler (QC). Alternatively, other types of fluid connectors may be used. In situations where only the pump unit 20 is used, an air hose from a work tool (not shown) may be connected directly to the output connector 84 of the output hose 80. In this case, a worker may transport only the pump unit 20 to the job site when only a small amount of compressed air is necessary to perform the job.

In another embodiment shown, the pump unit 20 may include an output connector located downstream of the pressure regulator 34 on the pump manifold 30. In this embodiment, any length of air hose may be connected to the output connector, or a hose of a work tool (not shown) may be directly connected to the output connector. In embodiments including an output connector, the manifold 30 includes an isolation valve such as a globe valve, gate valve, butterfly valve, etc., between the output connector and the pressure regulator 34 to prevent the compressed air from exiting the manifold 30 when no hose or tool is connected to the output connector.

The tank unit 50 includes a second tank 54, an inlet connector 56, a protective frame 60, a handle 61, and a tank manifold 70. In some embodiments, shown in FIGS. 4-9, the second tank 54 may be two or more air tanks 54*a*, 54*b* that are rigidly and fluidly connected together with an air flow path therebetween. The second tank 54 may be one or more "hot dog" style air tanks, one or more "pancake" style air tanks, or in other embodiments, the second tank 54 may be formed from various other shapes and geometries that are suitable for the use of the tank unit 50.

The inlet connector 56 provides a flow path for air to enter the second tank 54 from the pump unit 20. The inlet connector 56 may be a male quick connect coupler (QC) valve, but other types of connectors suitable for compressed gasses that are known in the art may be used. A check valve 58 may be provided between the second tank 54 and the inlet connector 56 to prevent the compressed air inside the second tank 54 from escaping to the atmosphere when the tank unit 50 is not connected to the pump unit 20. The check valve 58 allows compressed air at a higher pressure to enter the tank unit 50 through the inlet connector 56, but will prevent the flow of air from the second tank 54 in the reverse direction through the inlet connector 56. Any type of check valve that is suitable to prevent back flow of compressed gas may be used for the check valve 58. Alternatively, the check valve 58 may be replaced with an manually operable isolation valve (not shown) such as a gate valve, globe valve, butterfly valve, etc. to provide manual isolation for the second tank 54 in the tank unit 50.

The tank manifold 70 may be provided on the tank unit 50 and may include a tank pressure gauge 72, a pressure regulator 74 with an associated regulator pressure gauge 76, and one or more parallel output connectors 78 downstream of the pressure regulator 74. In some embodiments, female QC connectors are used for the output connectors 78, although other embodiments may use any type of fluid connectors that are suitable for removable connection with tools or devices using compressed gas for operation.

The regulator 74 may be operated to lower the pressure of air that flows through the output connectors 78 when connected to an output hose (not shown). The tank manifold 70 may further include a relief valve 71 that is set to lift at a pressure above the high end of the normal pressure range, but below the pressure rating of the second tank 54 to prevent a catastrophic failure of the second tank 54 due to an overpressure situation. Alternatively, the relief valve 71 may be directly attached to the second tank 54. The design and operation of relief valves that perform this function are well known in the art.

The pump unit 20 may be mechanically and fluidly connected to the tank unit 50. In this situation, the initial air flow path remains the same as discussed for the operation of only the pump unit 20, but the tank unit 50 is fluidly connected to the pump unit 20, through either the output connector of the pump unit manifold 30 or the output port 84 of the hose 80. Specifically, a hose 86 connects an output of the pump unit to the inlet connector 56 of the tank unit 50. In this situation, the first tank 26 is connected in series with the second tank 54 so that, in most situations, the pressure within the first tank 26 equalizes with the pressure in the second tank 54 after the two are connected (i.e. when the pressure in the first tank 26 is equal to or greater than the pressure in the second tank 54).

When operating the compressor 10 in this manner, the user normally fully backs opens the pump regulator 34, causing the pump regulator 34 to not control the air pressure flowing through the output connection, to allow the pressure within the first tank 26 and the second tank 54 to fully equalize. In addition to lowering the air pressure exiting the pump manifold 30, if the pump regulator 34 is maintained in operation when the second tank 54 is connected in series to the pump manifold 30, the pump regulator 34 limits the flow of air to the second tank 54, increasing the time required to equalize the pressure in the two tanks 26, 54 and limits the maximum pressure available in the second tank 54 to the pump regulator 34 setting.

As best shown in FIGS. 2 and 8, the pump unit 20 and the tank unit 50 can be operated remotely from each other. In this setup, a first end of an extension hose 86 is connected to the output of the pump manifold 30 and an opposite end of the extension hose 86 is connected to the input connector 56 on the tank unit 50. This allows the tank unit 50 to be physically remote from the pump unit 20, while remaining in fluid connection with the pump unit 20.

Figure 10:
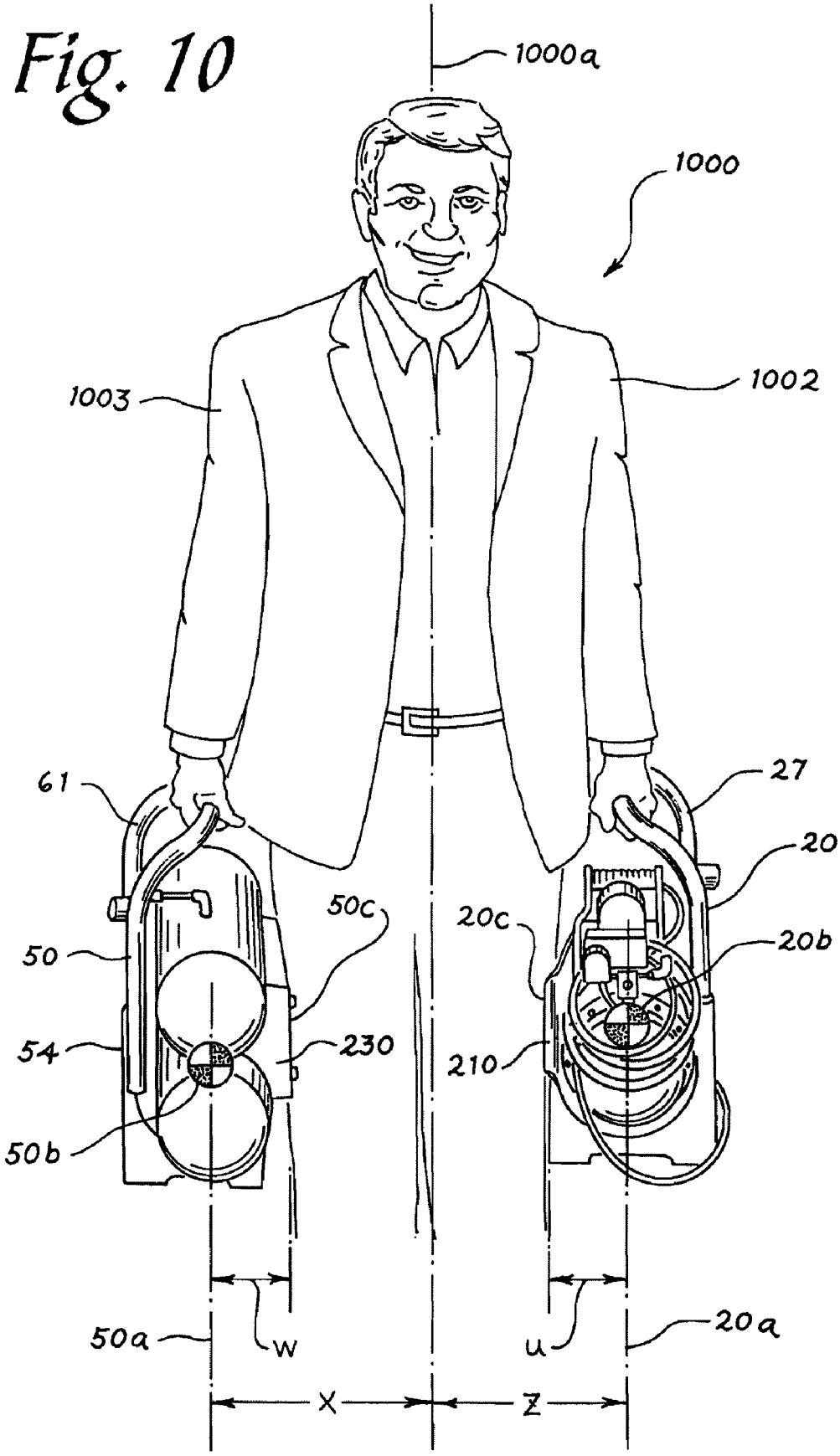
FIG. 10 is a front view of the air compressor of FIG. 4 mechanically disconnected and being carried on opposite sides of a user.

The pump and tank units 20, 50 can be mechanically and fluidly separated to allow the two units to be carried by the user on opposite hands on opposite sides of the user's body. Specifically, as best shown in FIG. 10, the pump and tank units 20, 50 may be carried by opposite hands and arms 1002, 1003 of the user 1000 and on opposite sides of the user's body at the same time. The user 1000 may carry the handle 27 of the pump unit 20 in a first hand 1002 and the handle 61 of the tank unit 50 in the opposite second hand 1003. In some embodiments the handles 27, 61 of each of the pump and tank units 20, 50, respectively, may be aligned substantially above and in a vertical plane 20*a*, 50*a*, with the center of gravity 20*b*, 50*b* of the respective pump and tank units 20, 50.

In this embodiment, the distance U, W between the center of gravity 20*b*, 50*b* and the side surface 20*c*, 50*c* of the respective pump and tank unit 20, 50 is minimized, which allows pump and tank units 20, 50 to be carried by the user 1000 while minimizing the distance Z, X between each center of gravity 20*b*, 50*b* of the respective pump and tank units 20, 50 and the centerline 1000*a* of the user 1000. This minimum distance Z, X allows the pump and tank units 20 to hang substantially straight downward from the user's 1000 hands and arms 1002, 1003, which limits the flex of the user's arms and wrists required to carry the two units 20, 50 of the air compressor 10 to provide for an ergonomic method for a user 1000 to carry the air compressor 10.

The minimum flex of the hands and arms 1002, 1003 allows the majority of the weight of the pump and tank units 20, 50 to be ultimately carried by the shoulders of the user 1000 and the remaining skeletal system of the user 1000, and not just by the respective hands and arms 1002, 1003. This orientation minimizes the amount of weight of the pump and tank units 20, 50 that must be carried by the hands and arms 1002, 1003, which is known to put localized strain and stress on the user's arm and hand muscles and increase the effort required to carry or hold the air compressor 10.

Each of the pump and tank units 20, 50 may be manufactured to be substantially the same weight to increase the user's 1000 ease of carrying the pump and tank units 20, 50 in opposite hands and arms 1002, 1003 as shown in FIG. 10. In some embodiments, each of the pump and tank units 20, 50 may be about 35 to 40 pounds. In other embodiments, the pump and tank units 20, 50 may be other weights that can be carried by the average user 1000 in opposite hands and arms 1002, 1003 on opposite sides of the user's 1000 body. In some embodiments, the pump and tank units 20, 50 are substantially the same weight such that the two units are less than five pounds different weights, on other embodiments, the pump and tank units 20, 50 are less than 10 pounds different weights. Because the pump and tank units 20, 50 may be substantially the same weight, the user may carry the units 20, 50 in opposite hands 1002, 1003 and maintain substantial upright balance due to a substantially even weight distribution between the respective right and left hands and arms 1002, 1003 while standing or while walking. Further, each of the pump and tank units 20, 50 may be formed to be substantially the same size and shape, to further provide for ergonomic and upright balanced carrying of the mechanically separated or detached air compressor 10, which further increases the user's right to left balance while carrying the air compressor 10 when standing or walking.

Figure 1:
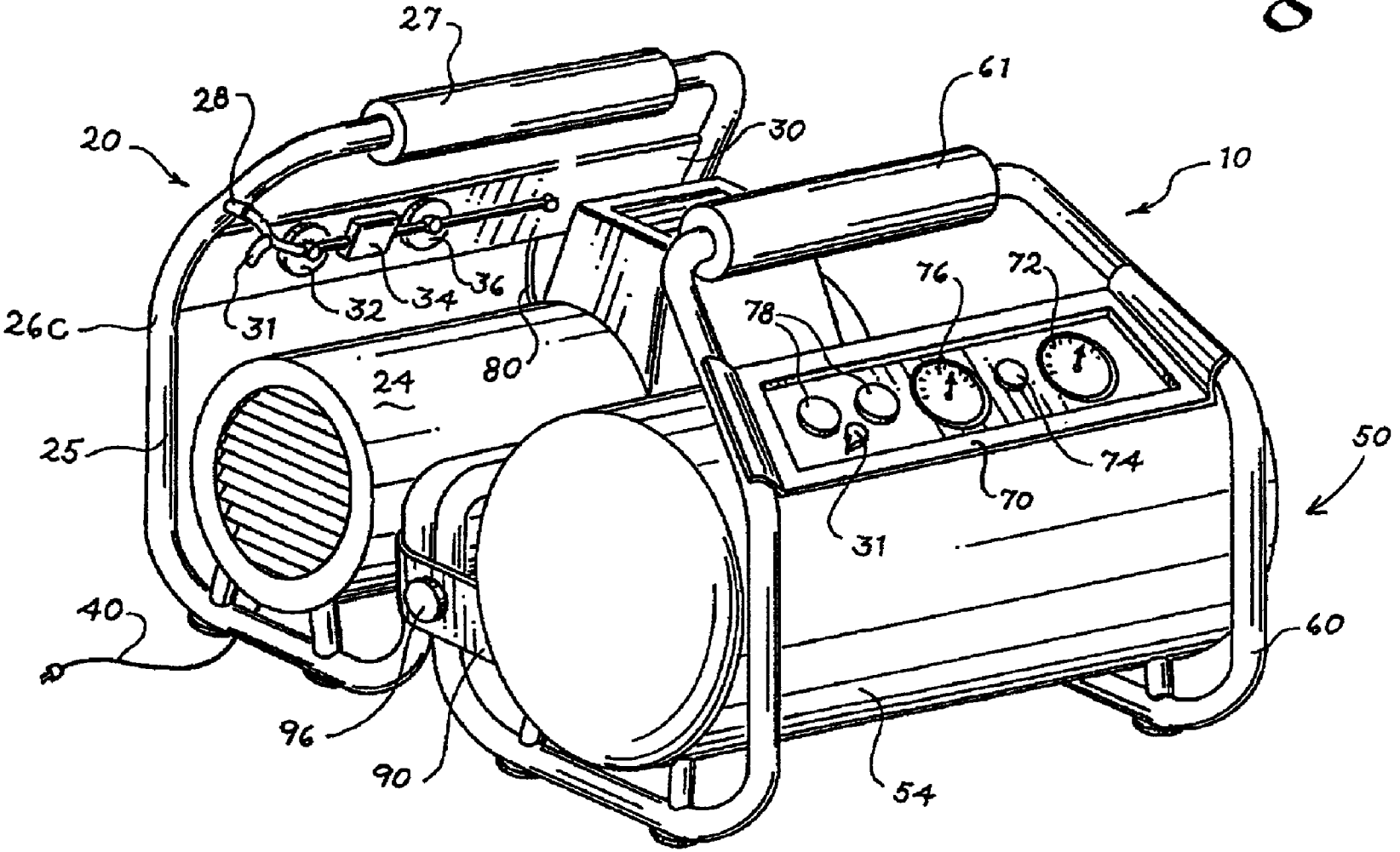
FIG. 1 is a perspective view of a first representative embodiment of the air compressor showing the pump unit and the tank unit mechanically connected.

As is shown in FIG. 1, the frames 25, 60 of the pump unit 20 and the tank unit 50, respectively, can be mechanically connected such that a user can carry both units together, with the user holding the handle 27 of the pump unit 20 in one hand and holding the handle 61 of the tank unit 50 in the other hand.

As shown in FIGS. 1-3, the pump unit frame 25 may be removeably mechanically attachable to a tank unit frame 60 of the tank unit 50 using a bracket 90. The bracket 90 includes a leaf 92 with an aperture 93 on the pump frame 25 and a leaf 94 with an aperture 95 on the tank unit tank frame 60 with a fastener 96 used to removeably connect the two leaves 92, 94. In the embodiments shown in FIGS. 1-3, the pump unit 20 and the tank unit 50 may be removeably attached with two brackets 90 on opposite sides of the frames 26, 60. In other embodiments, the two units 20, 50 can be connected with only one bracket, which may be on a side of the air tank 50 opposite the inlet connector 56.

Figure 4:
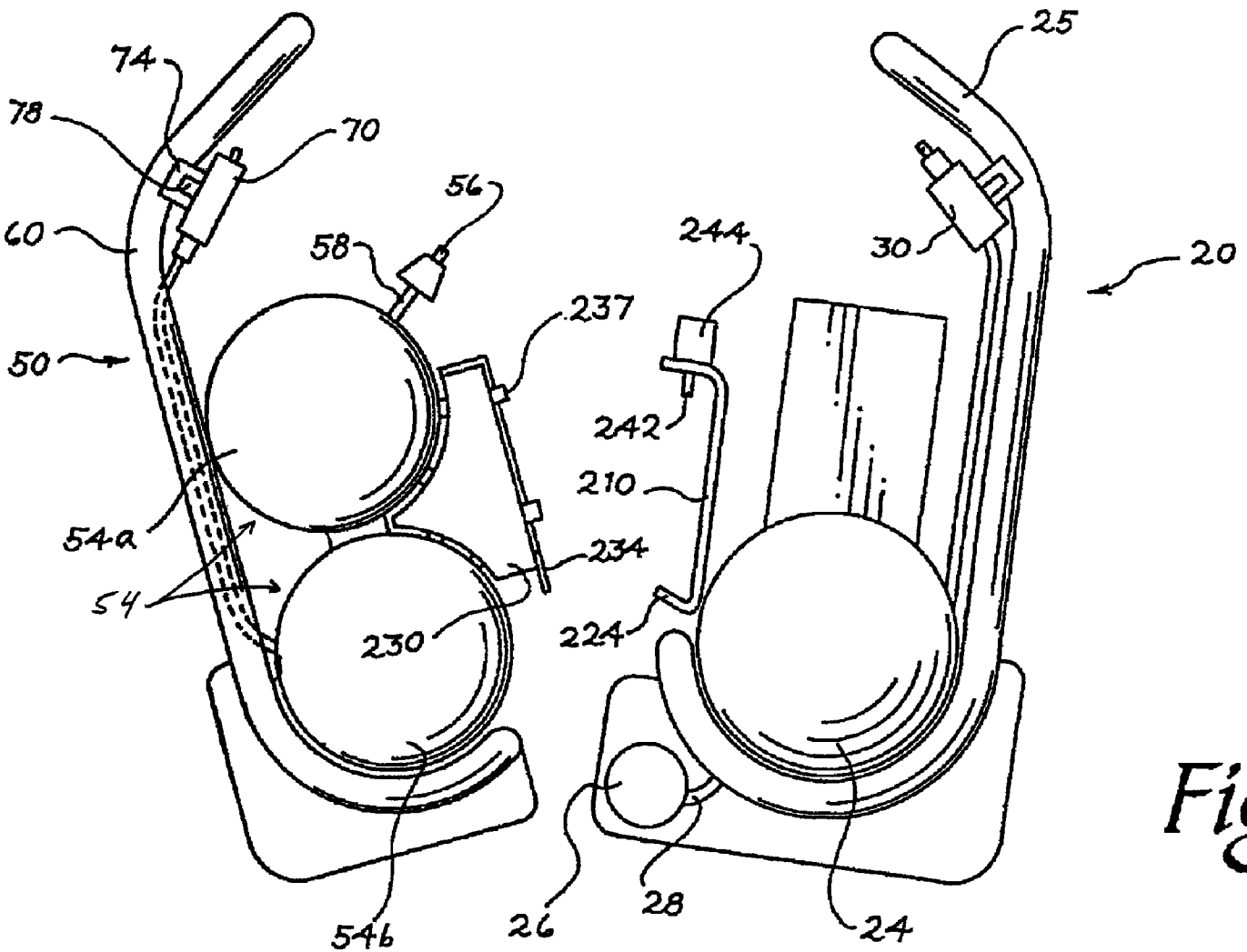
FIG. 4 is a side view of a third representative embodiment of the air compressor showing the pump and tank units mechanically disconnected.
Figure 5:
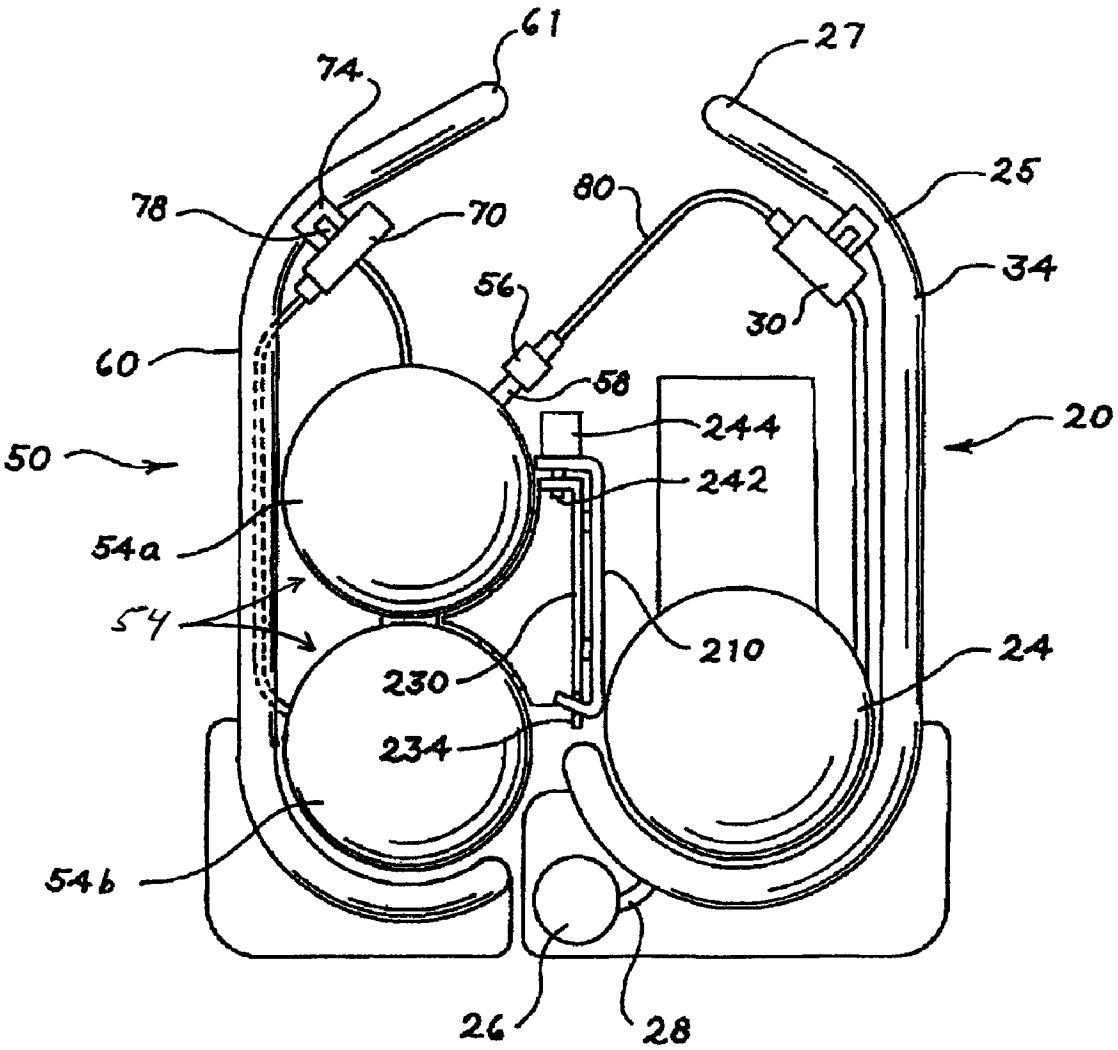
FIG. 5 is the view of FIG. 4 showing the pump and tank units mechanically connected.
Figure 6:
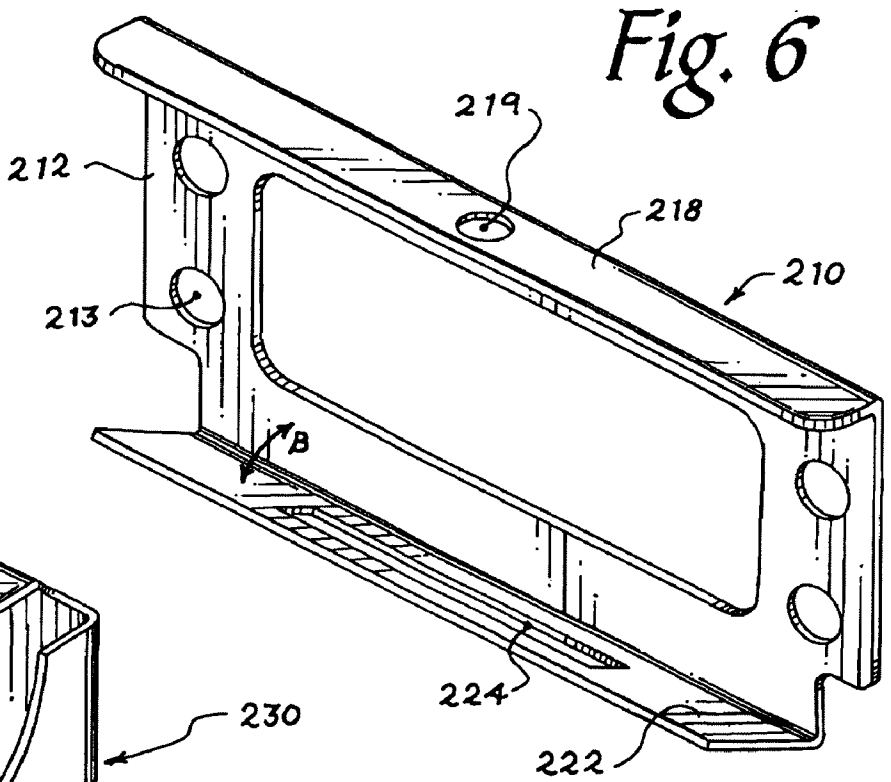
FIG. 6 is a perspective view of the pump unit plate of the air compressor of FIG. 4.

As shown in FIGS. 4-9, in an alternate embodiment, the pump unit frame 25 and the tank unit frame 60 may be removeably mechanically attachable with a pair of engageable plates, the pump unit and tank unit plates 210, 230, respectively. The pump unit plate 210 is fixed to the pump unit 20 and may have a cross-section shaped substantially like a channel iron. As best shown in FIG. 6, the pump unit plate 210 includes a vertical surface 212 that is mounted to either the pump unit frame 25, the air pump 24 and the first tank 26, or to other suitable surfaces of the pump unit 20 such that the vertical surface is substantially vertical when the pump and tank units 20, 50 are mechanically connected together.

As best shown in FIGS. 4 and 6, the pump unit plate 210 further includes a top flange 218 that may extend substantially perpendicular to the vertical surface 212. The top flange 218 includes an aperture 219 that receives a pin 242 mounted to a biasing member 244 (FIGS. 4-5), which is mounted to a top surface of the top flange 218. The pin 242 of the biasing member 244 normally extends through the aperture 219, while the biasing member 244 can be pulled upward away from the top flange 218 against the biasing force of a spring (not shown) within the biasing member 244, until the pin 242 no longer extends through the top flange 218. The engagement between the pin 242 and the aperture 239 of the tank unit plate 230 (discussed below) is a first independent mechanical connection between the tank and pump units 20, 50.

The pump unit plate 210 further includes a bottom flange 222 that is provided on an opposite edge of the vertical surface 212 from the top flange 218. The bottom flange 222 may extend from the vertical surface at an acute angle β from the vertical surface 212. In some embodiments, the angle β may be between 45 and 85 degrees. In other embodiments, the angle β may be between 50 and 65 degrees. In still other embodiments, the angle may be about 58 degrees or another angle within the ranges above. In other embodiments, the angle β may be other angles suitable to allow for connection between the pump unit plate 210 and the tank unit plate 230. The bottom flange 222 includes a slot 224 that is formed to selectively receive a tooth 234 defined on the tank unit plate 230, discussed below.

Figure 7:
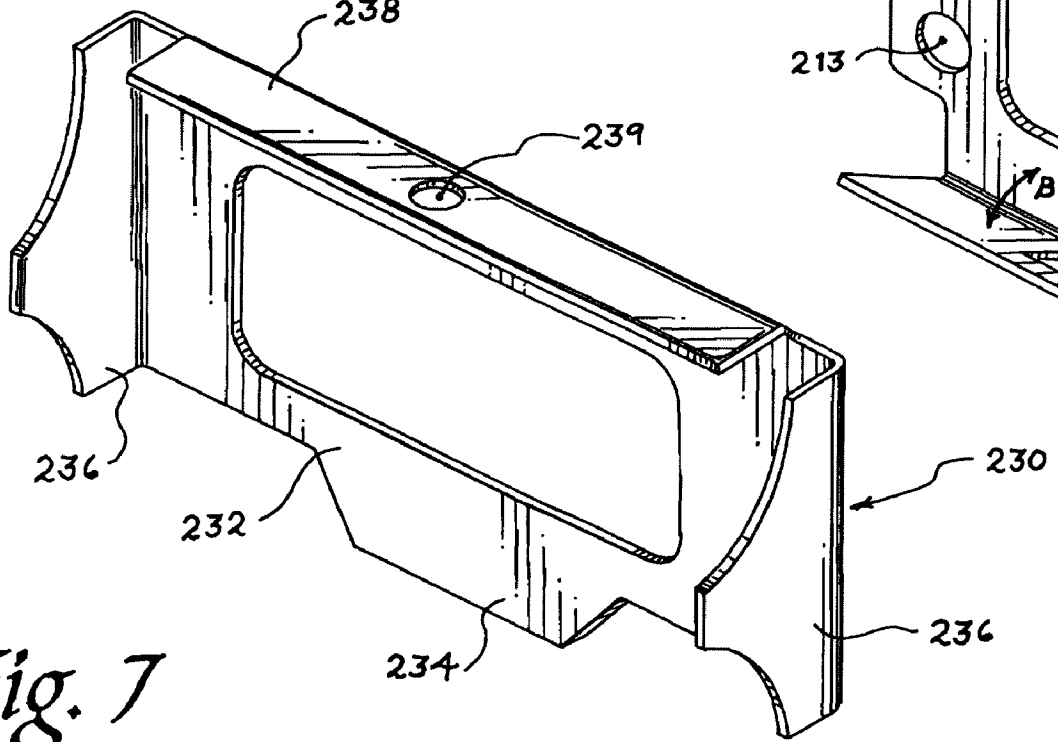
FIG. 7 is a perspective view of the tank unit plate of the air compressor of FIG. 4.

As best shown in FIGS. 5 and 7, the tank unit plate 230 is rigidly mounted to the tank unit 50 such the tank unit plate 230 has a vertical surface 232 that is mounted to the tank unit 50 to be substantially parallel to the vertical surface 212 of the pump unit plate 210 when the pump and tank units 20, 50 are mechanically connected together. As shown in FIGS. 4-7, the tank unit plate 230 may be rigidly mounted to the one or more second tanks 54 with suitable flanges 236 extending substantially perpendicularly from the vertical surface 232.

The tank unit plate 230 further includes a top flange 238 that extends inwardly toward the second tank 54 and substantially perpendicular to the vertical surface 232. The top flange 238 includes an aperture 239 that is coaxial with the aperture 219 on the pump unit plate 210, such that the aperture 239 on the tank unit plate 230 receives the pin 242 from the biasing member 244, which provides a portion of the mechanical connection between the pump and tank units 20, 50.

The tank unit plate 230 further includes a tooth 234 that extends from the vertical surface 232. The tooth 234 may be received within the slot 224 in the pump unit plate 210 to provide a second independent mechanical connection between the tank and pump units 20, 50.

In some embodiments, the tank unit plate 230 may include a plurality of feet 237 (FIGS. 4 and 9) that extend away from the air tank 54. The feet 237 may be received within a similar plurality of holes 213 defined in the pump unit plate 210 when the two plates 210, 230 are joined, to provide for an additional mechanical connection between the two units. Further, the feet 237 additionally provide a surface for contacting the floor or ground when the tank unit 50 is separated from the pump unit 20. Specifically, as shown in FIG. 8, the tank unit 50 normally is positioned in a horizontal orientation when not connected to the pump unit 20, such that a plane Y through the centers of the multiple second tanks 54*a*, 54*b* is substantially parallel with the ground, allowing the feet 237 to contact the ground.

In some embodiments, a rubber or other sufficiently flexible material may be provided on one of or both of the pump and tank unit plates 210, 230 in an orientation to contact the opposite pump and tank unit plate 210, 230 when the two are engaged. As shown schematically in FIG. 9, the rubber of other flexible material 231 is provided as a sheet on the tank unit plate 230 to contact the opposing surface of the pump unit plate 210. The rubber or other flexible material is provided to attenuate or reduce the transfer of vibrations created in one of the pump or tank units 20, 50 from being transferred to the other of the pump and tank units 20, 50. The rubber or other flexible material may be deposited on one or both of the pump and tank unit plates 210, 230 either in selected discrete locations or in other embodiments, the rubber or other flexible material may be deposited as a sheet on the surface of one or both of the pump and tank unit plates 210, 230 that all or substantially all of the contact between the two plates is through the rubber or other flexible surface.

In some embodiments (not shown), each of the pin 242 movable on the biasing member 244, the feet 237, the holes 213 receiving the feet 237, the tooth 234, and the slot 224 can be provided in a manner opposite of the pump and tank unit plates 210, 230 than discussed above. For example, in some embodiments, the biasing member 244 and the pin 242 may be provided on the top flange 238 of the tank unit plate 230 and extendable through the aperture 219 on the pump unit plate 210.

FIG. 4 provides a side view of the pump and tank units 20, 50 just prior to establishing the connection between the pump and tank unit plates 210, 230. Initially, the pump and tank units 20, 50 are placed with their respective plates 210, 230 positioned substantially parallel and in the vicinity of each other. Each of the pump and tank units 20, 50 are rotated away from each other, which raises the tooth 234 of the vertical surface 232 until the tooth 234 can be inserted into the slot 224 in the pump unit plate 210. Next, the pump and tank units 20, 50 are rotated toward each other, until the vertical surfaces 212, 232 of the plates are close to contacting each other. Finally, the biasing member 244 is pulled away from the top flange 218 of the pump unit plate 210, which allows the two apertures 219, 239 of the plates to align coaxially. The biasing member 244 is released and the pin 242 extends through the apertures 219, 239 in both of the plates 210, 230. In embodiments with feet 237 provided on the tank unit plate 230, the feet 237 extend through respective holes 213 in the pump unit plate 210. The pump and tank units 20, 50 can be mechanically disconnected by withdrawing the pin 242 from the tank unit plate 230 and rotating the two units away from each other to remove the tooth 234 from the slot 224.

In operation, as best shown in FIGS. 2-3 and 8, the pump and tank units 20, 50 may be operated remotely from each other. In this orientation, a first end of an air hose 86 of a suitable length may be connected to the output of the pump manifold 30 with a second end of the air hose 86 connected to the inlet connector 56 of the tank unit 50. Varying lengths of the air hose 86 may be used based on the desired distance between the pump and tank units 20, 50, but the system will have a higher pressure drop, or pressure lag, between the two units 20, 50 when longer hoses 86 are used. In this orientation, the user fully opens the pump regulator 34 so that the output pressure of the pump unit 20 is maintained at the pressure of the first tank 26. The operator adjusts the tank regulator 74 to adjust the output pressure from the tank manifold 70. In this orientation the tool is connected to one of the output connectors 78 on the tank manifold 70.

The air compressor 10 is operated similarly when the units 20, 50 are apart from each other as it operates when the units are connected by the bracket 90 (FIGS. 1-3) or the pump and the tank unit plates 210, 230 (FIGS. 4-9). When the air compressor 10 is provided with electrical power, the pump 24 cyclically runs to maintain the air pressure in the first tank 26 within the set pressure band. When the pressure switch (normally fluidly connected to the first tank 26) senses that the monitored pressure is at or below the low end of the band, the pump 24 energizes. When the monitored pressure reaches the high end of the pressure band, the air pump 24 secures and the monitored pressure decreases as air is withdrawn from the system for use.

In additional embodiments, the user may connect multiple tank units 50 in series to increase the air capacity of the system. In order to connect additional tank units 50, the user connects an air hose to one of the output ports 78 with the other end of the air hose to the inlet connection 56 on the second tank unit 50. Preferably, the user fully backs off the tank regulator 74 on the first tank unit 50 and controls pressure with the tank regulator 74 on the second tank unit 50, which is where the user connects their work tool. It is also possible to maintain the first tank regulator in operation in order to connect a tool to the manifold of the first tank unit 50 and connect a tool to the manifold 70 of a second tank unit 50 as well. In this orientation, the first tank regulator 74 may have difficulty maintaining the desired air pressure in the second tank unit 50 if it is heavily cycled because the first tank regulator 74 limits the flow of air from the first tank unit 50 to the second tank unit 50, which may be less than the amount of air that is drawn off of the second tank unit 50 by the user.

Figure 9:
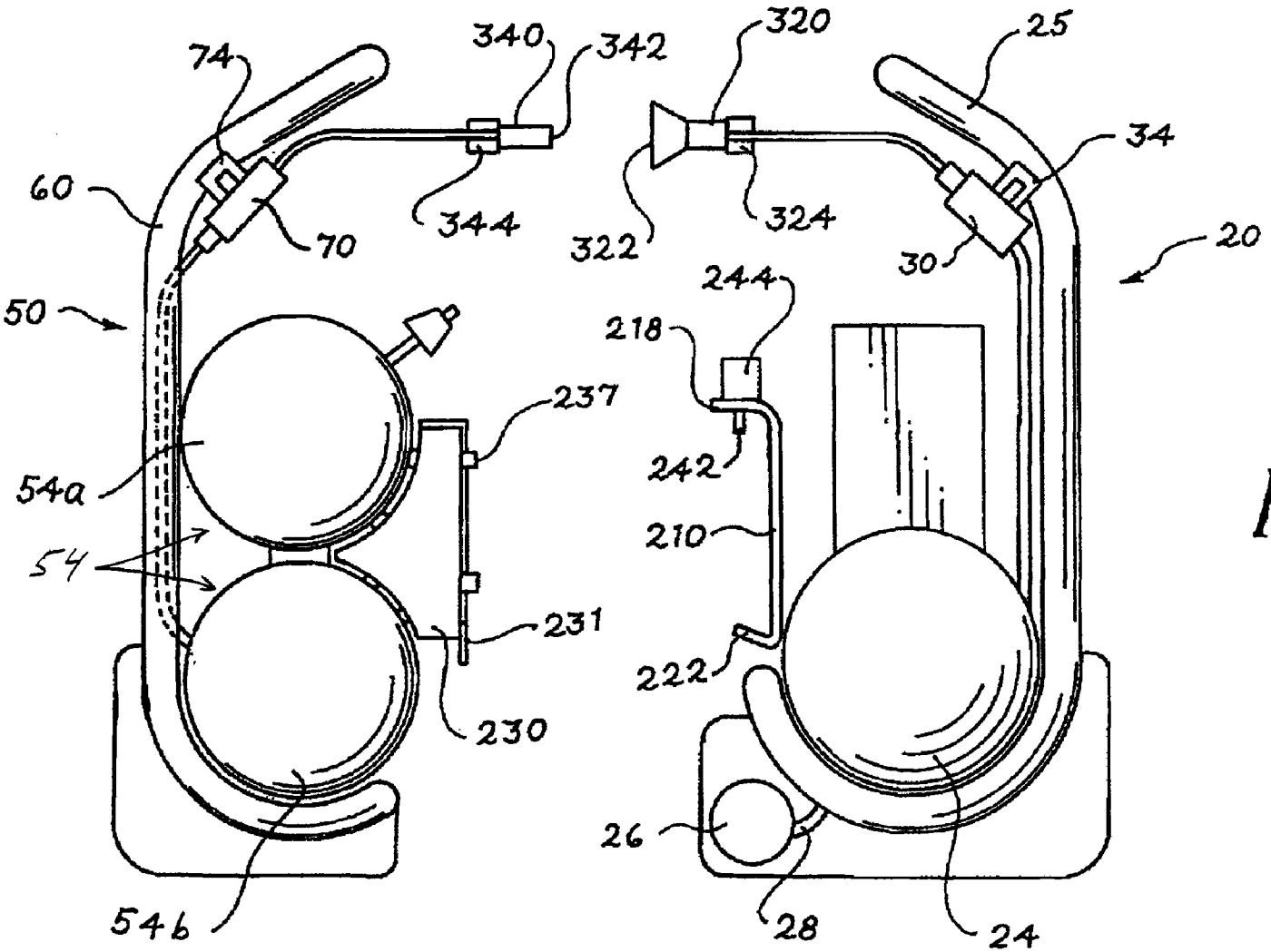
FIG. 9 is a side view of a fourth representative embodiment of the air compressor showing the pump and tank unit mechanically and fluidly disconnected.

In an alternate embodiment shown in FIG. 9, the pump and tank units 20, 50 may be fluidly connected using an automatic connection system. The automatic connection system fluidly connects the two units 20, 50 whenever the two units are mechanically connected, with either the pump and tank unit plates 210, 230, the bracket 90, or with any other type of suitable mechanical connection. The outlet of the pump manifold 30 includes a female connector 320 fluidly connected downstream of the pump regulator 34. The female connector 320 is sized to fluidly receive a corresponding male connector 340 that is fluidly connected to the second tank 54.

As the pump and tank units 20, 50 are rotated or otherwise moved toward each other to interlock the plates 210, 230, the bracket 90, or other similar mechanical connection structure, the male connector 340 of the tank unit 50 is inserted within a cone-like distal end 322 of the female connector 320, which aligns a distal end 342 of the male connector 340 to make a tight fluid seal with the female connector 320. The male and female connectors 320, 340 are removable from fluid connection when the pump and tank units are rotated or moved. In some embodiments, each of the male and female connectors 320, 340 include isolation valves 324, 344 upstream of the respective connector to provide for fluid isolation of the respective unit when the two are not fluidly connected.

While the preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

What is claimed is:

1. An air compressor comprising:

a first unit comprising an air pump;

a first air tank in fluid communication with the air pump;

a first frame supporting the air pump and the first air tank, the first frame including a portion adjacent a first side of the air pump and a first handle positioned above the air pump;

a first coupling member adjacent a second side of the air pump;

a second unit comprising a second air tank;

a second frame supporting the second air tank, the second frame including a portion adjacent a first side of the second air tank and a second handle positioned above the second air tank; and a second coupling member adjacent a second side of the second air tank;

wherein the first and second coupling members are mechanically connectable to interconnect the first and second units, and wherein the first and second air tanks are fluidly connectable independent of the mechanical connection between the first and second units.

2. The air compressor of claim 1 wherein the first air tank is defined within the internal volume of the first frame.

3. The air compressor of claim 1 wherein the second air tank comprises at least two air tanks fluidly connected together.

4. The air compressor of claim 1 wherein the first unit further comprises a first manifold including a first output port and a pressure regulator associated with the first air tank.

5. The air compressor of claim 4 wherein the second unit further comprises a second manifold including a second output port and a pressure regulator associated with the second air tank.

6. The air compressor of claim 5 wherein a work tool may be directly connected to the first output port.

7. The air compressor of claim 5 further comprising an input connection in selective fluid communication with the second air tank; and a valve positioned between the input connection and the second air tank.

8. The air compressor of claim 7 wherein the first output port is fluidly connectable to the input connection on the second air tank, and wherein the valve is a check valve allowing flow from the first air tank to the second air tank but preventing flow from the second air tank to the first air tank.

9. The air compressor of claim 1 wherein the first and second units comprise respective first and second output ports fluidly connected to the respective first and second air tanks.

10. The air compressor of claim 9 wherein the first and second units comprise respective first and second pressure regulators fluidly connected between the respective first and second air tanks and the respective first and second output ports.

11. The air compressor of claim 1 wherein the first and second coupling members comprise respective first and second plates that are engageable to mechanically connect the first and second units.

12. The air compressor of claim 11 wherein one of the first and second plates comprises a tooth and the other of the first and second plates comprises a slot that receives the tooth when the first and second plates are engaged.

13. The air compressor of claim 11 wherein one of the first and second plates comprises a pin and the other of the first and second plates comprises an aperture to receive the pin when the first and second plates are engaged.

14. The air compressor of claim 1 wherein the first and second units are capable of being carried simultaneously on opposite sides of a user's body.

15. The air compressor of claim 14 wherein the second unit further comprises a third air tank in fluid communication with the second air tank and capable of fluid communication with the first air tank.

16. The air compressor of claim 14 wherein each of the first and second units is formed to be substantially the same weight.

17. The air compressor of claim 14 wherein each of the first and second units is formed to be substantially the same volume.

18. The air compressor of claim 14 wherein the first and second units are capable of being carried separately with opposite arms of the user extending substantially vertically downward from the user's shoulders.

19. The air compressor of claim 1 wherein the first handle is substantially aligned with a vertical plane passing through a center of gravity of the first unit.

20. The air compressor of claim 19 wherein the portion of the first frame adjacent the air pump and the first coupling member are positioned on opposite sides of the vertical plane.

21. The air compressor of claim 1 wherein the second handle is substantially aligned with a vertical plane passing through a center of gravity of the second unit.

22. The air compressor of claim 21 wherein the portion of the second frame adjacent the second air tank and the second coupling member are positioned on opposite sides of the vertical plane.

23. The air compressor of claim 1 wherein the air pump is positioned between the first frame and the first coupling member.

24. The air compressor of claim 1 wherein the second air tank is positioned between the second frame and the second coupling member.

* * * * *